US010875746B2

(12) United States Patent
Lanphier et al.

(10) Patent No.: US 10,875,746 B2
(45) Date of Patent: Dec. 29, 2020

(54) LIFT FIXTURE FOR HEAT EXCHANGER HEADER

(71) Applicant: E&C FinFan, Inc., Ball Ground, GA (US)

(72) Inventors: Michael Lanphier, Tulsa, OK (US); David Snell, Tulsa, OK (US)

(73) Assignee: E&C FinFan, Inc., Ball Ground, GA (US)

( * ) Notice: Subject to any disclaimer, the term of this patent is extended or adjusted under 35 U.S.C. 154(b) by 0 days.

(21) Appl. No.: 16/656,031

(22) Filed: Oct. 17, 2019

(65) Prior Publication Data

US 2020/0122980 A1 Apr. 23, 2020

Related U.S. Application Data

(60) Provisional application No. 62/747,633, filed on Oct. 18, 2018.

(51) Int. Cl.

| | |
|---|---|
| ***B66F 1/00*** | (2006.01) |
| ***B66C 1/66*** | (2006.01) |
| *F28F 9/02* | (2006.01) |

(52) U.S. Cl.

CPC ..... *B66C 1/66* (2013.01); *F28F 9/02* (2013.01); *F28F 2280/00* (2013.01)

(58) Field of Classification Search

None

See application file for complete search history.

(56) References Cited

U.S. PATENT DOCUMENTS 1,983,215 A * 12/1934 Byler ..... B63C 7/20 114/55
4,358,421 A * 11/1982 Jabsen ..... G21C 3/326 376/271
5,280,982 A * 1/1994 Kobayashi ..... B66C 1/54 294/116
6,254,157 B1 * 7/2001 Yakushinji ..... B66C 1/422 294/110.1
2006/0202497 A1 * 9/2006 Cveykus ..... B66C 1/585 294/118

FOREIGN PATENT DOCUMENTS

NL 1035440 C2 11/2009

OTHER PUBLICATIONS

International Search Report and Written Opinion from the Internationai Searching Authority for Internationai Application No. PCT/US2019/056750, dated Feb. 3, 2020 (15 pages).

* cited by examiner

*Primary Examiner* — Gerald McClain
(74) *Attorney, Agent, or Firm* — Cook Alex Ltd.; R. Blake Johnston

(57) ABSTRACT

A fixture for lifting a heat exchanger header includes a first leg including a first receiver slot and a second leg including a second receiver slot and a first load arm pivotally attached to an upper portion of the first leg and a second load arm pivotally attached to an upper portion of the second leg. In use, the upper end portions of the first and second load arms are engaged by a lifting device. A first scissor arm is pivotally attached to the second leg and slidingly attached to the first leg by the first receiver slot. A second scissor arm is pivotally attached to the first leg and slidingly attached to the second leg by the second receiver slot. First and second connection plates are secured to the lower portions of the first and second legs and are connected to the tubing aperture of the heat exchanger header.

20 Claims, 5 Drawing Sheets

LIFT FIXTURE FOR HEAT EXCHANGER HEADER

CLAIM OF PRIORITY

This application claims the benefit of U.S. Provisional Application No. 62/747,633, filed Oct. 18, 2018, the contents of which are hereby incorporated by reference.

FIELD OF THE INVENTION

The present invention generally relates to the manufacture of air-cooled heat exchangers, and more particularly, but not by way of limitation, to an improved tool for lifting heavy components during the manufacturing a heat exchanger.

BACKGROUND OF THE INVENTION

Heat exchangers are used in a wide variety of industrial applications. A process fluid, either a gas or a liquid, is passed through a series of cooling tubes while air is mechanically passed over the exterior of the cooling tubes. The air absorbs heat from the cooling tubes, thereby lowering the temperature of the fluid within the tubes. The cooling tubes may include lateral or axial fins to aid in heat transfer.

The cooling tubes extend between two or more headers (or header boxes) positioned on opposite sides of the heat exchanger. The headers include an inlet or an outlet to permit the flow of the process fluid through the heat exchanger. In many applications, the process fluid is under elevated temperatures and pressures. To safely contain the elevated pressure of the process fluid, the headers are manufactured by welding substantial metal plates together. Although effective, the metal plates used to fabricate the headers are heavy. For large air-cooled heat exchangers, each header may weigh up to 10,000 pounds.

In past, headers have been moved around the manufacturing facility by inserting one or more steel posts through holes in the headers and securing a chain around the ends of the steel posts and around the header. This approach is undesirable because the chain may slip or twist about the steel posts and the chain wrap around the header frustrates efforts to lay the header down without interference from the chain. The existing method of lifting headers is time-consuming and requires skilled application to avoid damage or injury. Accordingly, there is a need for an improved system and method for lifting and moving headers during the manufacture of large air-cooled heat exchangers. The presently preferred embodiments are directed to these and other deficiencies in the prior art.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a fixture for lifting a heat exchanger header having tubing apertures includes a first leg including a first receiver slot and a second leg including a second receiver slot. A first load arm is pivotally attached to an upper portion of the first leg and a second load arm is pivotally attached to an upper portion of the second leg and the upper end portions of the first and second load arms are configured to be engaged by a lifting device. A first scissor arm has a pivot end pivotally attached to the second leg and a sliding end portion attached to the first leg by the first receiver slot. A second scissor arm has a pivot end pivotally attached to the first leg and a sliding end portion attached to the second leg by the second receiver slot. A first connection plate is secured to a lower portion of the first leg and includes a first connection aperture. A second connection plate is secured to a lower portion of the second leg and includes a second connection aperture. The first and second connection apertures are configured to be aligned with a tubing aperture of a heat exchanger header.

In another aspect, a fixture for lifting a heat exchanger header having tubing apertures includes a first leg including a first receiver slot and a second leg including a second receiver slot. A first load arm is pivotally attached to an upper portion of the first leg and a second load arm is pivotally attached to an upper portion of the second leg. The upper end portions of the first and second load arms are configured to be engaged by a lifting device. A first scissor arm is pivotally attached to the second leg and slidingly attached to the first leg by the first receiver slot. A second scissor arm is pivotally attached to the first leg and slidingly attached to the second leg by the second receiver slot. A first connection plate is secured to a lower portion of the first leg and a second connection plate is secured to a lower portion of the second leg. The first and second connection plates are configured for connection to a tubing aperture of a heat exchanger header.

In still another aspect, a method of lifting a heat exchanger header having tubing apertures includes the steps of: connecting a lift device to a lift fixture, where the lift fixture includes opposing first and second connection plates having first and second connection apertures and a scissor mechanism having a lift point, where the scissor mechanism is configured to move the first and second connection plates towards one another when the lift point is raised, placing the first connection plate and the second connection plate of the lift fixture on opposite sides of the heat exchanger header, aligning the first connection aperture of the first connection plate and the second aperture of the second connection plate with a tubing aperture of the heat exchanger header, inserting a rod through the first and second connection apertures and the tubing aperture of the heat exchanger header and raising the lift point of the lift fixture using the lift device so that the first and second connection plates cooperatively grip the heat exchanger header.

WRITTEN DESCRIPTION

Figure 3:
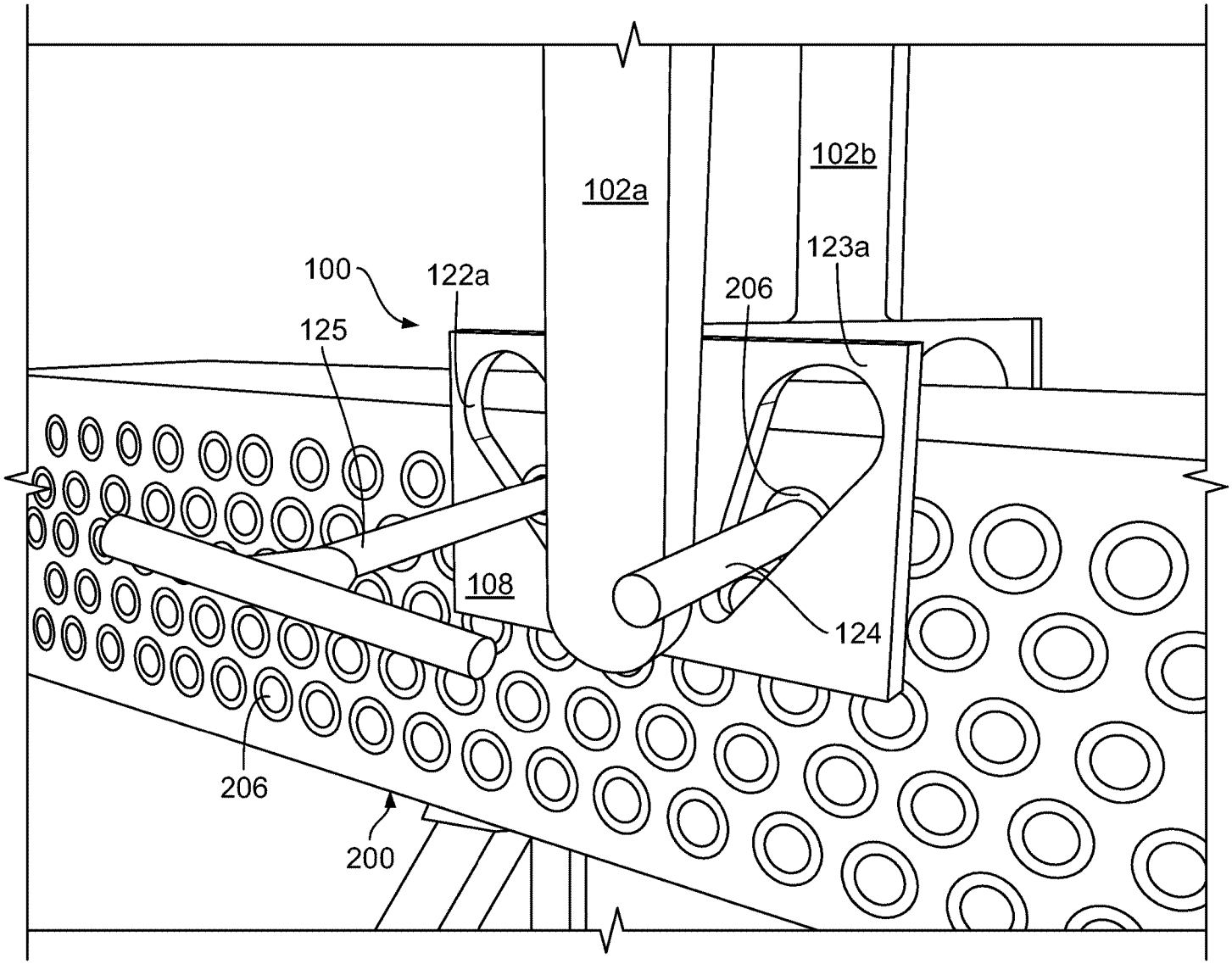
FIG. 3 is a close-up depiction of the connection between the header lift fixture and a header in a horizontal position.
Figure 4:
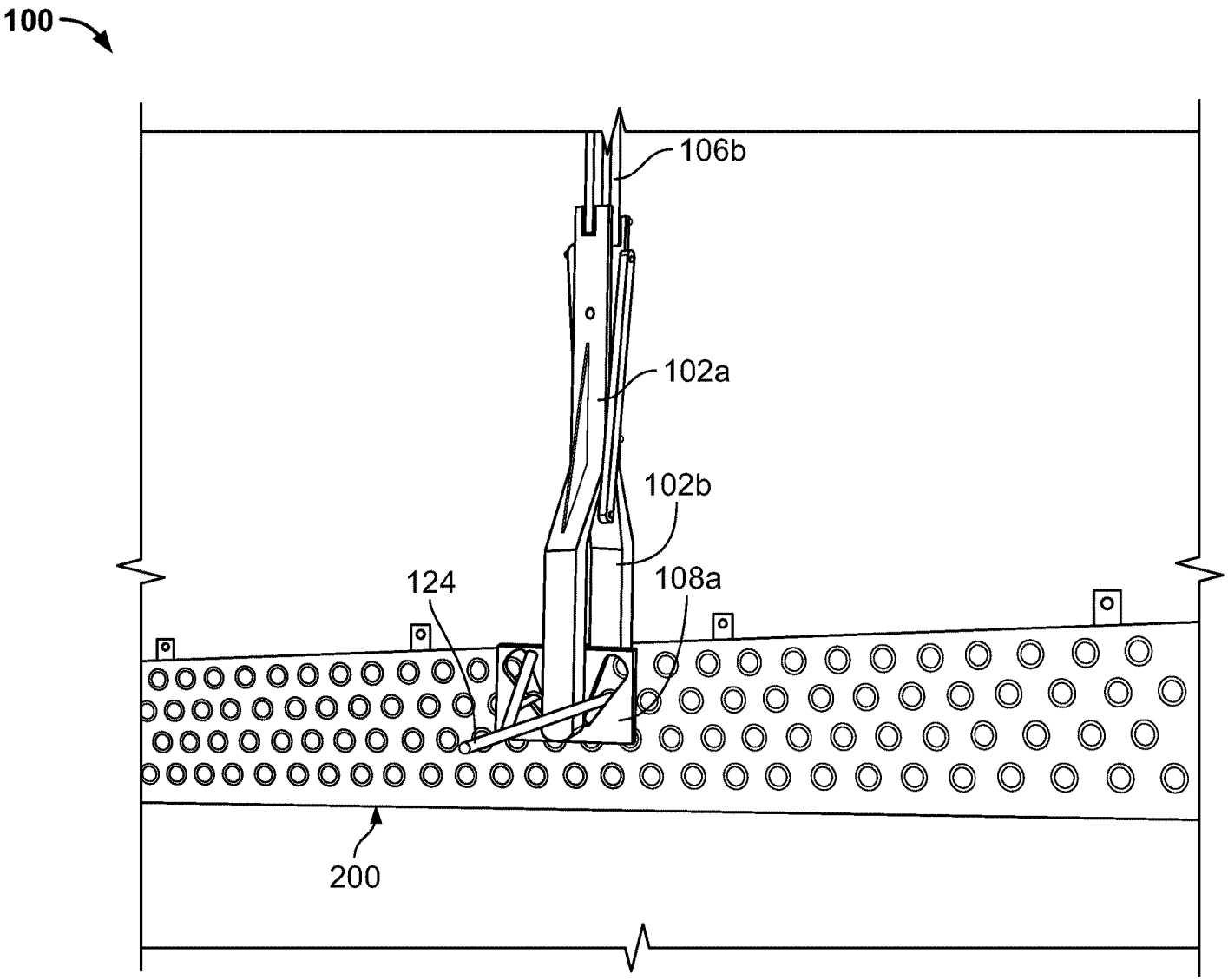
FIG. 4 is a depiction of the header lift fixture and header from FIG. 3 during a lift.
Figure 5:
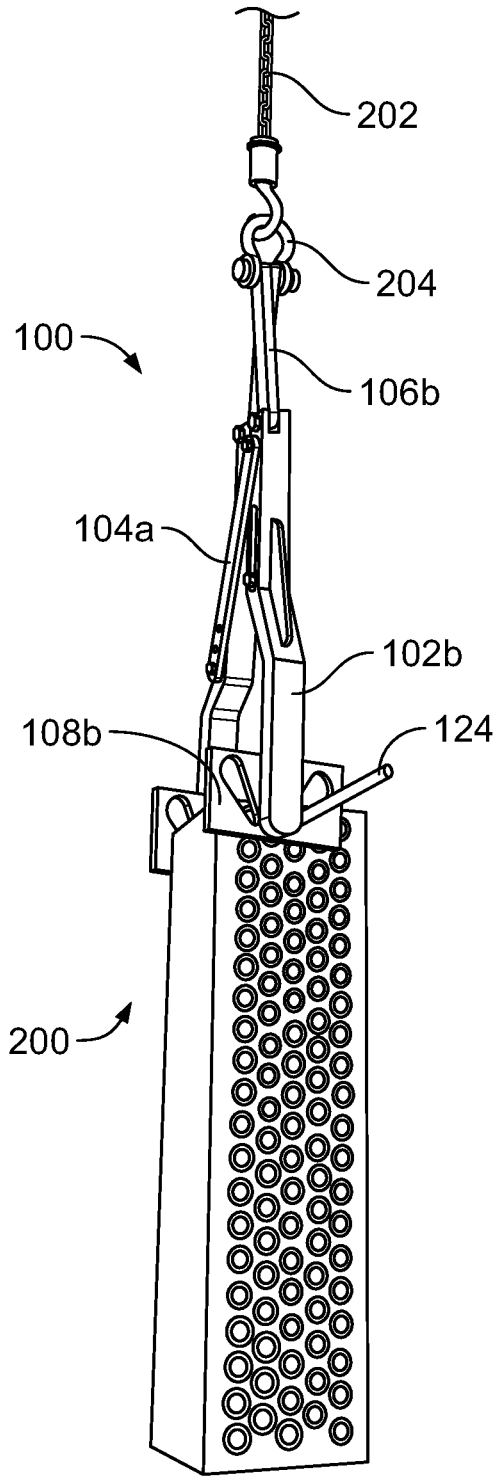
FIG. 5 is a depiction of the header lift fixture connected to a hoist and header in a vertical position.

Referring to FIGS. 1-5, shown therein are various depictions of a header lift fixture 100 constructed accordance with an exemplary embodiment of the present invention. The header lift fixture 100 is designed to be connected between a header 200 (FIGS. 3-5) and a lifting device 202 (FIG. 5). The header lift fixture 100 is well suited to be used to lift a variety of headers 200 that are manufactured for use in connection with heat exchangers (not shown), and in particular large air-cooled heat exchangers. The lifting device 202 can be a hoist, crane, forklift, gantry or other lifting device that includes a load bearing connector 204 (FIG. 5) capable of connecting to the header lift fixture 100. In some embodiments, the load bearing connection 204 is an anchor shackle, a hook, a ring, or any other connection arrangement known in the art.

In the depicted embodiment, the header lift fixture 100 includes a pair of legs 102*a* and 102*b*, a pair of scissor arms 104*a* and 104*b*, a pair of load arms 106*a* and 106*b*, and pair of connection plates 108*a* and 108*h*. Each of the legs 102*a* and 102*b* includes a receiver slot 110*a* and 110*b* and a receiver hole, as illustrated for leg 102*b* in FIG. 2 at 112*b*. Each of the scissor arms 104*a* and 104*b* includes an upper bolt hole (shown in FIG. 1 and FIG. 2 receiving bolt 114 for scissor arm 104*a*) and a lower bolt hole 116 that are configured to align with a corresponding receiver hole, as illustrated for 02b in FIG. 2 at 112*b*, and receiver slot 110*a* or 110*b* of the legs 102*a* and 102*b*, respectively. As noted in FIG. 1, the scissor arms 104*a* and 104*b* may include multiple lower fastener holes 116, 117 and 119 to allow the header lift fixture 100 to be adjusted for use in connection with headers 200 of different sizes. As an example only, a bolt may be used as the fastener passing through a selected one of the fastener holes and the corresponding receiver slots.

The scissor arms 104*a* and 104*b* are sized such that each scissor arm 104*a* 104*b* extends between the two legs 102*a* and 102*b*. More specifically, a first scissor arm 104*a* extends from the receiver hole 112*a* on the second leg 102*b* to the receiver slot 110*a* on the first leg 102*b*. A second scissor arm 104*b* extends from the receiver hole 112*a* on the first leg 102*a* to the receiver slot 110*b* on the second leg 102*b*. The scissor arms 104*a* and 104*b* can thus be pinned or bolted between the first and second legs 102*a* and 102*b* to permit the relative rotation of the scissor arms 104*a* and 104*b* with respect to the legs 102*a* and 102*b*. Similarly, the load arms 106*a* and 106*b* are each connected to a separate one of the legs 102*a* and 102*h* through load arm bolt holes, as illustrated for leg 102*b* in FIG. 2 at 118*b*. The opposite ends of the load arms 106 are coupled to the load bearing connector 204 of the lifting device 202 through a lift point such as lift opening 120 (formed through the overlapping upper end portions of load arms 106*a* and 106*b*). The lift point may take alternative forms such as a bracket or member connected to the lift opening 120.

In certain embodiments, it may be desirable to bolster the strength of the legs 102*a* and 102*b* with braces 126*a* and 126*b*. The optional braces 126*a* and 126*b* limit extent to which the legs 102*a* and 102*b* flex during a lift. The braces 126*a* and 126*b* can be welded to the legs 102*a* and 102*b*. Unless otherwise indicated, the various components of the header lift fixture 100 are manufactured from high carbon, high strength steel.

Figure 1:
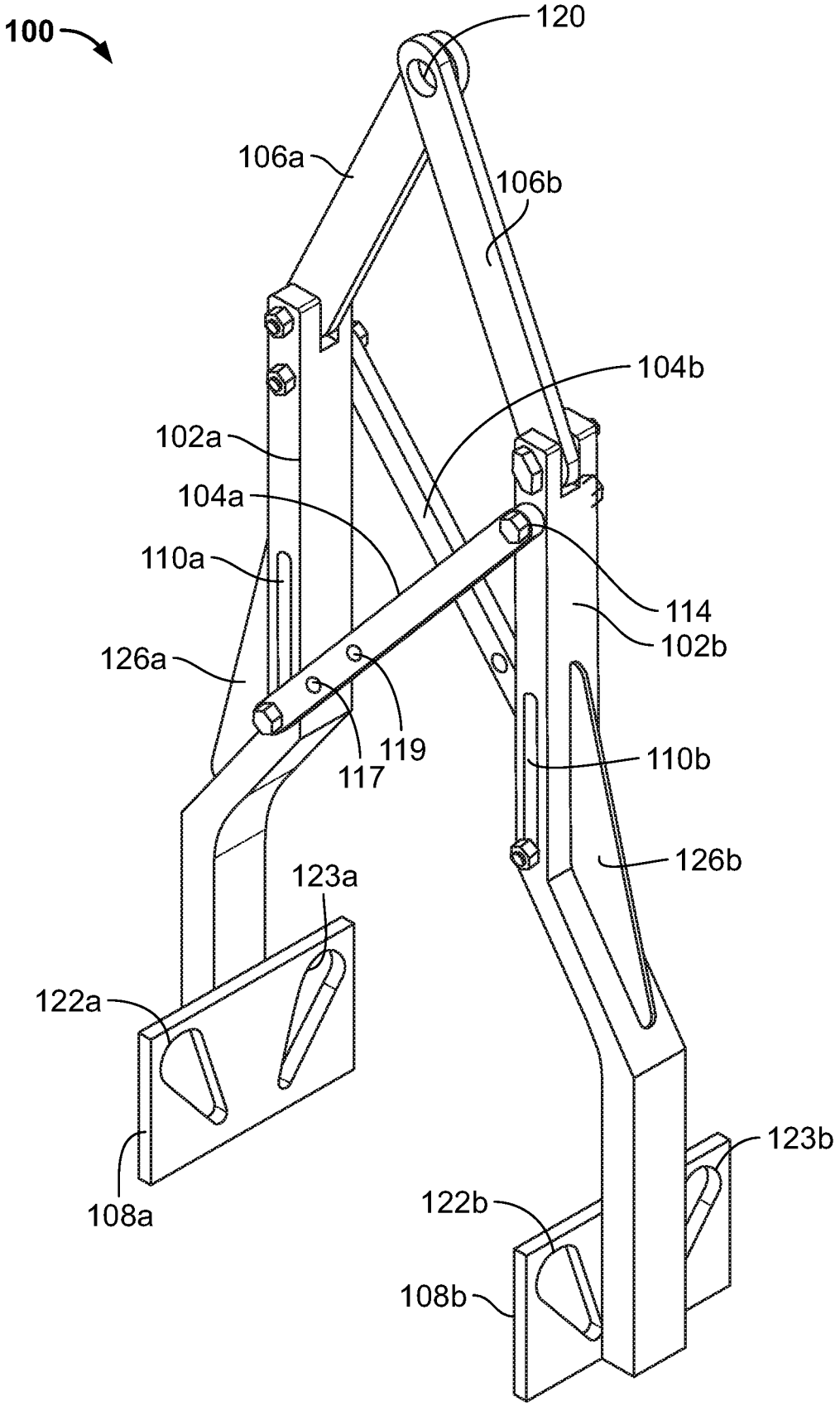
FIG. 1 provides a perspective view of a header lift fixture constructed in accordance with an exemplary embodiment.
Figure 2:
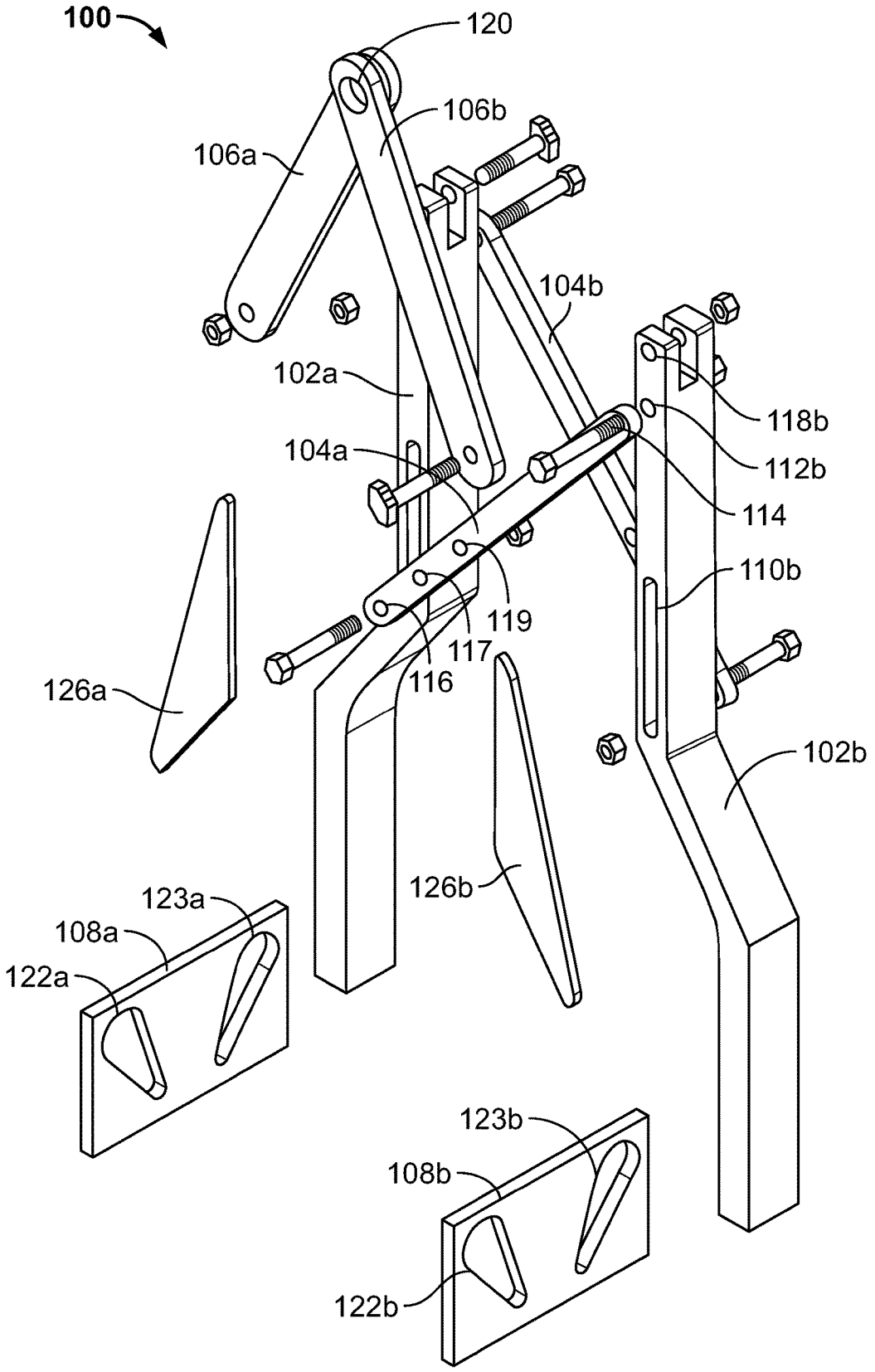
FIG. 2 is an exploded parts view of the header lift fixture of FIG. 1.

As best illustrated in FIGS. 1 and 2, the middle portions of legs 102*a* and 102*b* may optionally be angled outwards below the slots 110*a* and 110*b* so that the horizontal spacing between the opposing lower portions of legs 102*a* and 102*b* is greater than the horizontal spacing between the opposing upper portions of legs 102*a* and 102*b*.

The connection plates 108*a* and 108*b* are secured to the lower end of each of the legs 102*a* and 102*b*. In some embodiments, the connection plates 108*a* and 108*b* are welded to the lower end of the legs 102*a* and 102*b*. The connection plates 108*a* and 108*b* include one or more connection apertures 122*a*, 123*a* and 122*b* and 123*b* that are sized to permit carrying rods 124 and 125 (FIGS. 3-5) to extend through the connection apertures 122*a*, 123*a* and 122*a*, 123*b*. Each of the carrying rods 124 and 125 has an outer diameter that is smaller than the diameter of a tubing aperture 206 (FIG. 3) in the header 200. Each carrying rod 124 and 125 has a length that is greater than the combined width of the header 200 and the connection plates 108*a* and 108*b*. A pair of carrying rods 124 and 125 may be used to lift the header 200 (as depicted in FIGS. 3 and 4) or a single carrying rod 124 may be used (as depicted in FIG. 5). The carrying rods 124 can be held in place within the connection apertures of the connection plates 108 by frictional resistance created by the weight of the header 200. As a backup measure, clamps (not shown) can be placed over the ends of the carrying rods 124 to ensure that the carrying rods 124 do not become disengaged from the connection plates 108*a* and 108*b* during a lifting operation.

Generally, the legs 102*a* and 102*b*, scissor arms 104*a* and 104*b* and lifting arms 106*a* and 106*b* cooperate to produce a "scissor" mechanism in which the application of a tensile load between the connection plates 108 and the lifting arms 106, such as which occurs when the lift point 120 is pulled vertically upwards while carrying rods extend through a header and the connection apertures of the connection plates 108*a* and 108*b*, causes the legs 102 to be drawn together as the header lift fixture 100 elongates, thereby applying a compressive force to the header 200 between the connection plates 108*a* and 108*b*.

In an exemplary method of use, a load bearing connector 204 (FIG. 5) is first connected to the lifting device 202. The load arms 106*a* and 106*b* of the header lift fixture 100 are then connected to the load bearing connector 204 through the lift point 120. The header lift fixture 100 can then be carried by the lifting device 202 to the header 200. The header lift fixture 100 is then lowered over the header 200 and the legs 102*a* and 102*b* and scissor arms 104*a* and 104*b* are spread outward so that the connection plates 108*a* and 108*b* fit around the outside of the header 200. One or more carrying rods 124 (and 125) are then extended through the connection plates 108*a* and 108*b* and the tubing apertures 206 of the header 200.

Once the header lift fixture 100 has been preliminarily connected to the header 200 with the carrying rods 124, the lifting device 202 raises the header lift fixture 100. As the header lift fixture 100 is raised and tension is applied by the weight of the header 200, the header lift fixture 100 elongates through the scissor mechanism and the connection plates 108 apply a compressive lateral "squeeze" force to stabilize the header 200 during the lift while securing the carrying rods 124 (and 125) within the connection apertures 122*a*, 123*a* and 122*b*, 123*b*.

When the lift is complete, the lifting device 202 lowers the header 200 until the weight of the header 200 is no longer transferred through the header lift fixture 100. Once the header lift fixture 100 is not exposed to the weight of the header 200, the carrying rods 124 (and 125) can be removed and the legs 102*a* and 102*b* can be separated up and away from the header 200.

Thus, the header lift fixture 100 provides a safe, reliable and efficient way to lift headers 200 during the manufacture and assembly of heat exchangers. Although the exemplary embodiments have been depicted in connection with the header 200, it will be appreciated that in other embodiments the header lift fixture 100 can be used to lift other components or equipment without significant modification. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms expressed herein. It will be appreciated by those skilled in the art that the teachings of the present invention can be applied to other systems without departing from the scope and spirit of the present invention.

What is claimed is:

1. A fixture for lifting a heat exchanger header, where the heat exchanger header has tubing apertures, the fixture comprising:

a. a first leg including a first receiver slot and a second leg including a second receiver slot;

b. a first load arm pivotally attached to an upper portion of the first leg and a second load arm pivotally attached to an upper portion of the second leg and wherein upper end portions of the first and second load arms are configured to be engaged by a lifting device;

c. a first scissor arm having a pivot end pivotally attached to the second leg and a sliding end portion attached to the first leg by the first receiver slot;

d. a second scissor arm having a pivot end pivotally attached to the first leg and a sliding end portion attached to the second leg by the second receiver slot;

e. a first connection plate secured to a lower portion of the first leg and including a first connection aperture;

f. a second connection plate secured to a lower portion of the second leg and including a second connection aperture, said first and second connection apertures configured to be aligned with a tubing aperture of a heat exchanger header.

2. The fixture of claim 1 wherein the pivot end of the first scissor arm is attached to the second leg between a pivot connection of the second load arm and the second receiver slot and the pivot end of the second scissor arm is attached to the first leg between a pivot connection of the first load arm and the first receiver slot.

3. The fixture of claim 1 wherein the upper end portions of the first and second load arms overlay one another and a lift opening is formed through the overlaying upper end portions.

4. The fixture of claim 1 wherein the sliding end portion of the first scissor arm includes a plurality of first fastener holes configured so that a first fastener may pass through a selected one of the plurality of first fastener holes and the receiver slot of the first leg and the sliding end portion of the second scissor arm includes a plurality of second fastener holes configured so that a second fastener may pass through a selected one of the plurality of second fastener holes and the receiver slot of the second leg.

5. The fixture of claim 4 wherein the first and second fasteners are bolts.

6. The fixture of claim 1 wherein the first load arm is pivotally attached to the first leg by a bolt and the second load arm is pivotally attached to the second leg by a bolt.

7. The fixture of claim 1 wherein the first scissor arm is pivotally attached to the second leg by a bolt and the second scissor arm is pivotally attached to the first leg by a bolt.

8. The fixture of claim 1 wherein middle portions of the first and second legs are angled so that opposing lower portions of the first and second legs are spaced further apart than opposing upper portions of the first and second legs.

9. The fixture of claim 8 further comprising a first brace secured to the upper and middle portions of the first leg and a second brace secured to the upper and middle portions of the second leg.

10. A fixture for lifting a heat exchanger header, where the heat exchanger header has tubing apertures, the fixture comprising:

a. a first leg including a first receiver slot and a second leg including a second receiver slot;

b. a first load arm pivotally attached to an upper portion of the first leg and a second load arm pivotally attached to an upper portion of the second leg and wherein upper end portions of the first and second load arms are configured to be engaged by a lifting device;

c. a first scissor arm pivotally attached to the second leg and slidingly attached to the first leg by the first receiver slot;

d. a second scissor arm pivotally attached to the first leg and slidingly attached to the second leg by the second receiver slot;

e. a first connection plate secured to a lower portion of the first leg and a second connection plate secured to a lower portion of the second leg, said first and second connection plates configured for connection to a tubing aperture of a heat exchanger header.

11. The fixture of claim 10 wherein the a first connection plate includes a first connection aperture and the second connection plate includes a second connection aperture, wherein the first and second connection apertures are configured to receive a rod passing through tubing apertures of a heat exchanger header.

12. The fixture of claim 10 wherein the first scissor arm is attached to the second leg between a pivot connection of the second load arm and the second receiver slot and the pivot end of the second scissor arm is attached to the first leg between a pivot connection of the first load arm and the first receiver slot.

13. The fixture of claim 10 wherein the upper end portions of the first and second load arms overlay one another and a lift opening is formed through the overlaying upper end portions.

14. The fixture of claim 10 wherein a sliding end portion of the first scissor arm includes a plurality of first fastener holes configured so that a first fastener may pass through a selected one of the plurality of first fastener holes and the receiver slot of the first leg and a sliding end portion of the second scissor arm includes a plurality of second fastener holes configured so that a second fastener may pass through a selected one of the plurality of second fastener holes and the receiver slot of the second leg.

15. The fixture of claim 14 wherein the first and second fasteners are bolts.

16. The fixture of claim 10 wherein the first load arm is pivotally attached to the first leg by a bolt and the second load arm is pivotally attached to the second leg by a bolt.

17. The fixture of claim 10 wherein the first scissor arm is pivotally attached to the second leg by a bolt and the second scissor arm is pivotally attached to the first leg by a bolt.

18. The fixture of claim 10 wherein middle portions of the first and second legs are angled so that opposing lower portions of the first and second legs are spaced further apart than opposing upper portions of the first and second legs.

19. The fixture of claim 18 further comprising a first brace secured to the upper and middle portions of the first leg and a second brace secured to the upper and middle portions of the second leg.

20. A method of lifting a heat exchanger header, where the heat exchanger header has a plurality of tubing apertures, comprising the steps of:

a. connecting a lift device to a lift fixture, where the lift fixture includes opposing first and second connection plates having first and second connection apertures and a scissor mechanism having a lift point, where the scissor mechanism is configured to move the first and second connection plates towards one another when the lift point is raised;

b. placing the first connection plate and the second connection plate of the lift fixture on opposite sides of the heat exchanger header;

c. aligning the first connection aperture of the first connection plate and the second aperture of the second connection plate with a tubing aperture of the heat exchanger header;

d. inserting a rod through the first and second connection apertures and the tubing aperture of the heat exchanger header;

e. raising the lift point of the lift fixture using the lift device so that the first and second connection plates cooperatively grip the heat exchanger header.

* * * * *